US012497717B2

(12) United States Patent
Himmelstoss et al.

(10) Patent No.: US 12,497,717 B2
(45) Date of Patent: Dec. 16, 2025

(54) JACQUARD HEDDLE AND LOOM COMPRISING SUCH A JACQUARD HEDDLE

(71) Applicant: Staubli Lyon, Chassieu (FR)

(72) Inventors: Michael Himmelstoss, Luzinay (FR); Pierre-Alexis Griviau, Villeurbanne (FR)

(73) Assignee: Staubli Lyon, Chassieu (FR)

( * ) Notice: Subject to any disclaimer, the term of this patent is extended or adjusted under 35 U.S.C. 154(b) by 0 days.

(21) Appl. No.: 18/942,297

(22) Filed: Nov. 8, 2024

(65) Prior Publication Data

US 2025/0154695 A1 May 15, 2025

(51) Int. Cl.

| | |
|---|---|
| ***D03C 9/04*** | (2006.01) |
| ***D03C 9/02*** | (2006.01) |
| *D03C 3/00* | (2006.01) |

(52) U.S. Cl.

CPC ..... *D03C 9/024* (2013.01); *D03C 9/026* (2013.01); *D03C 9/04* (2021.08)

(58) Field of Classification Search

CPC ..... D03C 9/024; D03C 9/026; D03C 9/04; D03C 3/40

See application file for complete search history.

(56) References Cited

U.S. PATENT DOCUMENTS 776,216 A * 11/1904 Butcher ..... D03C 9/024 139/94
1,524,700 A * 2/1925 Farmer ..... D03C 3/40 139/94
1,944,516 A * 1/1934 King ..... D03C 9/024 139/94
4,197,881 A * 4/1980 Sage ..... D03C 3/24 139/59
4,383,557 A * 5/1983 Graf ..... D03C 9/02 139/96
6,014,989 A * 1/2000 Tachon ..... D03C 3/40 139/85
6,883,553 B2 * 4/2005 Bassi ..... D03C 9/02 139/93

(Continued)

FOREIGN PATENT DOCUMENTS

JP S55139185 U 10/1980
JP 2001-303384 A 10/2001

OTHER PUBLICATIONS

Search Report issued in FR 2312250, dated Apr. 26, 2024.

*Primary Examiner* — Robert H Muromoto, Jr.
(74) *Attorney, Agent, or Firm* — MARSHALL, GERSTEIN & BORUN LLP

(57) ABSTRACT

A Jacquard heddle including a link, including an upper hole and a lower hole of circular cross-section. A first single-filament wire is engaged in the upper hole forming an upper loop and a second single-filament wire is engaged in the lower hole forming a lower loop. The Jacquard heddle includes an upper end connector to which two end portions of the first wire are linked and a lower end connector to which two end portions of the second wire are linked. The upper loop defines a free opening extending from the upper hole to the connection of the two end portions of the first wire with the upper end connector. The lower loop defines a free opening extending from the lower hole to the connection of the two end portions of the second wire with the lower end connector.

17 Claims, 9 Drawing Sheets

(56) References Cited

U.S. PATENT DOCUMENTS

| | | | | |
|---|---|---|---|---|
| 2007/0017592 | A1* | 1/2007 | Gaubert | D03C 3/40 139/59 |
| 2007/0084518 | A1* | 4/2007 | Himmelstoss | D03C 9/02 139/11 |
| 2008/0083471 | A1* | 4/2008 | Mettler | D03C 9/02 139/93 |
| 2016/0108561 | A1* | 4/2016 | Herrmann | D03C 9/02 29/4.6 |
| 2016/0108562 | A1* | 4/2016 | Herrmann | D03C 9/0625 139/93 |
| 2016/0108563 | A1* | 4/2016 | Herrmann | D03C 9/026 139/93 |
| 2018/0023224 | A1* | 1/2018 | Himmelstoss | D03C 3/38 139/93 |

* cited by examiner

JACQUARD HEDDLE AND LOOM COMPRISING SUCH A JACQUARD HEDDLE

FIELD

The present invention relates to a Jacquard heddle configured to be mounted on a Jacquard loom and a loom comprising such a Jacquard heddle.

The heddles of a Jacquard loom should limit the impact thereof on the density of warp threads and limit the catches of neighboring warp threads. During weaving on a Jacquard loom, in particular when the warp threads are thick, the heddle links may be carried along the warp thread feeding direction, resulting in the heddles bending out of the longitudinal plane, or the contact between the heddle link and neighboring warp threads may cause a misalignment of the heddle body and of the heddle link in the longitudinal plane. In a Jacquard loom, the heddles are particularly long compared to a frame loom, and hence subject to bending in the feeding direction of the warp threads.

BACKGROUND

JPS55139185 describes a heddle for a loom frame, which is thus not a Jacquard loom. The heddle is formed of a link, an upper wire and a lower wire. The upper yarn is inserted into an upper triangular housing of the link and the lower yarn is inserted into a lower triangular housing of the link. To be hooked to the triangular housing, each yarn is wound on itself, thereby forming a twist.

JP2001303384 discloses another construction, wherein two yarns are twisted around a directly mounted annular link. Such known heddles would not be suitable in the case of a Jacquard loom, in particular in cases where the warp threads are thick and apply a large bending force to the link of the heddle in the feeding direction. Indeed, such known heddles poorly withstand the stresses imposed by the Jacquard loom, in that, when the heddles are deformed under bending outside the longitudinal plane, the twists forming the links between the heddle bodies and the link are strongly stressed. Thereof can cause incipient breaking and premature wear of the heddles, in particular of the twists. Moreover, the known heddles are not protected from corrosive environments, which tends to said incipient breaking.

U.S. Pat. No. 776,216A discloses a Jacquard heddle formed of a link, an upper metal wire and a lower metal wire respectively passing through a circular opening in the link. The two wires are pressed into contact with the link and a weld is applied at the connection between each wire and the link. The connection of each wire with the link by shape cooperation and by welding are strongly stressed when the heddles are deformed under bending outside the longitudinal plane.

SUMMARY

The goal of the invention is then to propose a new Jacquard heddle, by means of which the risk of breaking of the heddle is reduced, in particular when a warp thread passing through the heddle is thick.

To this end, the invention relates to a Jacquard heddle for guiding a warp thread for a Jacquard loom, the Jacquard heddle extending along a longitudinal axis and comprising:

- a link, comprising a convex outer edge and two flat, parallel and opposite main faces, the link being traversed, from one of the main faces to the other, by an eye for the passage of the warp thread, by an upper hole and by a lower hole, the upper hole and the lower hole being arranged on both sides of the eye along the longitudinal axis;
- a first wire, engaging in the upper hole and forming an upper loop; and
- a second wire, which is distinct from the first wire and which is engaged in the lower hole forming a lower loop.

According to the invention:

- the Jacquard heddle comprises an upper end connector, comprising means of connection to a first element of a Jacquard harness, two end portions of the first wire being connected to the upper end connector; and
- the Jacquard heddle comprises a lower end connector, comprising means of connection to a second element of the Jacquard harness, two end portions of the second wire being connected to the lower end connector;
- the upper hole has a circular cross-section;
- the lower hole has a circular cross-section;
- the upper loop defines a free opening extending, along the longitudinal axis, from the upper hole to the connection of the two end portions of the first wire with the upper end connector;
- the lower loop delimits a free opening extending, along the longitudinal axis, from the lower hole to the connection of the two end portions of the second wire with the lower end connector;
- the first wire is the only connection between the link and the upper end connector and is a single-filament wire of constant diameter; and
- the second wire is the only connection between the link and the lower end connector and is a single-filament wire of constant diameter.

By means of the invention, when the heddle is bent while being carried along a feeding direction by the warp thread passing through the eye, a pivoting of the link with respect to the upper body is permitted, by a pivoting of the upper hole in the free opening of the loop of the upper body. Similarly, a pivoting of the link with respect to the lower body is permitted by the pivoting of the lower hole in the free opening of the loop of the lower body. The pivoting of the link inside the loops is favored by the cooperation of the circular wire forming the body with the circular hole of the link wherein same is engaged and allows the heddle to deform without generating bending stress at the connection between the link and the upper body, or the lower body respectively. The risk of the heddle breaking is thereby reduced.

According to other advantageous aspects of the invention, the Jacquard loom comprises one or a plurality of the following features, taken individually or according to all technically possible combinations:

- a diameter of the upper hole is greater than or equal to twice, preferentially 2.5 times, the diameter of the first wire. The diameter of the upper hole is preferentially less than 3.5 times, the diameter of the first wire;
- a diameter of the lower hole is greater than or equal to twice, preferentially 2.5 times, the diameter of the second wire. The diameter of the lower hole is preferentially less than 3.5 times, the diameter of the second wire;
- the thickness of the link, measured from one of the main faces to the other, perpendicular to the longitudinal axis, is less than twice the smallest diameter between the diameter of the first wire and the diameter of the second wire;

the outer edge of the link comprises two central portions which extend along the longitudinal axis and an upper portion, respectively a lower portion, ending with an upper rounded portion, respectively a lower rounded portion, and wherein the upper portion, respectively the lower portion, corresponds to a progressive reduction in the width of the main faces from the central portions toward the upper rounded portion, the lower rounded portion, respectively, the width being taken along a direction perpendicular to the longitudinal axis and parallel to the main faces;

the upper rounding is centered on the upper hole and extends at least 100° around the center of the upper hole;

the lower rounding is centered on the lower hole and extends over at least 100° around the center of the lower hole;

a height of the eye, measured parallel to the longitudinal axis, is at least five times greater than the largest diameter between an upper hole diameter and a lower hole diameter;

the link is made of metal, preferably of stainless steel;

the eye comprises an upper edge and a lower edge, delimiting the eye along the longitudinal axis, the upper edge and the lower edge being perpendicular to the longitudinal axis and wherein a width of the eye is strictly greater than the largest diameter between the diameter of the upper hole and the diameter of the lower hole, preferably 2.5 to 3.5 times greater;

the first wire and the second wire are made of Nylon;

the first wire and the second wire are made of metal;

the upper end connector is made of polymer material, overmolded on the two end portions of the first wire;

the lower end connector, is made of polymer material, overmolded on the two end portions of the second wire;

the upper end connector comprises a housing extending through along a direction perpendicular to the longitudinal axis for the partial reception of the two end portions of the first wire which are connected thereto;

the lower end connector, comprises a housing extending through along a direction perpendicular to the longitudinal axis for the partial reception of the two end portions of the second wire which are connected thereto;

the connection between the two end portions of the first wire and the upper end connector comprises a tube, arranged around the housing and pressing the two end portions of the first wire into contact with the upper end connector;

the connection between the two end portions of the second wire and the lower end connector comprises a tube, arranged around the housing and pressing the two end portions of the second wire into contact with the lower end connector;

the connection between the two end portions of the first wire and the upper end connector comprises an outer sheath which is partially arranged around the upper end connector and the first wire; and the connection between the two end portions of the second wire and the lower end connector comprises an outer sheath which is partially arranged around the lower end connector and the second wire.

A further subject matter of the invention relates to a Jacquard loom comprising a plurality of Jacquard heddles, at least one of the Jacquard heddles of which is according to the foregoing.

BRIEF DESCRIPTION OF THE DRAWINGS

The invention will be clearer upon reading the following description, given only as an example, but not limited to, and making reference to the drawings wherein.

DESCRIPTION

Figure 1:
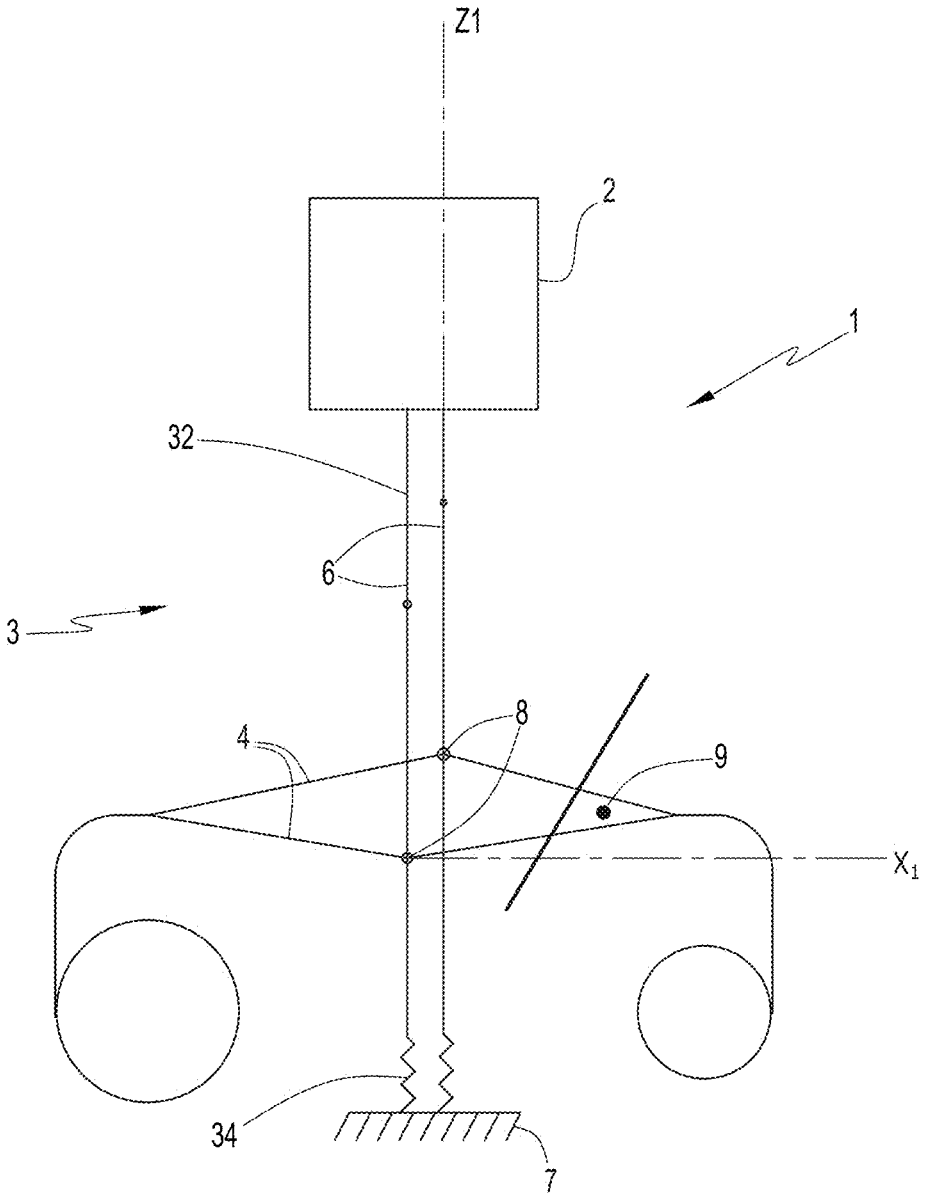
FIG. 1 is a schematic side view of Jacquard loom comprising two Jacquard heddles according to a first embodiment of the invention.

A Jacquard loom 1, according to a first embodiment of the invention, shown schematically in FIG. 1, comprises a Jacquard shedding mechanism 2, a harness 3 within which are integrated Jacquard heddles 6, a loom frame 7 and warp threads 4. The shedding mechanism 2 controls a plurality of hooks (not shown).

The harness 3 comprises a plurality of arches 32 connecting, respectively, a Jacquard heddle 6 to a lower end of a hook of the shedding mechanism 2. In the configuration mounted in the harness 3, and excluding any deformation during weaving, each Jacquard heddle 6 is stretched along a respective longitudinal, preferentially vertical, axis Z1. The Jacquard heddles 6 are advantageously distributed in depth and over the width of the Jacquard loom 1. Each Jacquard heddle 6 is connected to a respective return spring 34 belonging to the harness 3, the return spring 34 as such being connected to the loom frame 7. Each Jacquard heddle 6 comprises a respective link 8 traversed by a warp thread 4. At each stroke of the Jacquard loom 1, the shedding mechanism 2 selectively imposes a vertical movement, along the longitudinal axis Z1, of the Jacquard heddles 6 via the arches 32, which brings the warp threads 4, carried by the Jacquard heddles 6, into different predetermined positions along the longitudinal axis Z1, so as to form a fabric with the warp threads 4 and a weft thread 9 inserted through the shed formed by the warp threads 4 by means of the positioning of the Jacquard heddles 6. At each stroke of the Jacquard loom 1, the warp threads 4 move forward along a feeding direction X1 perpendicular to the axis Z1.

Figure 2:
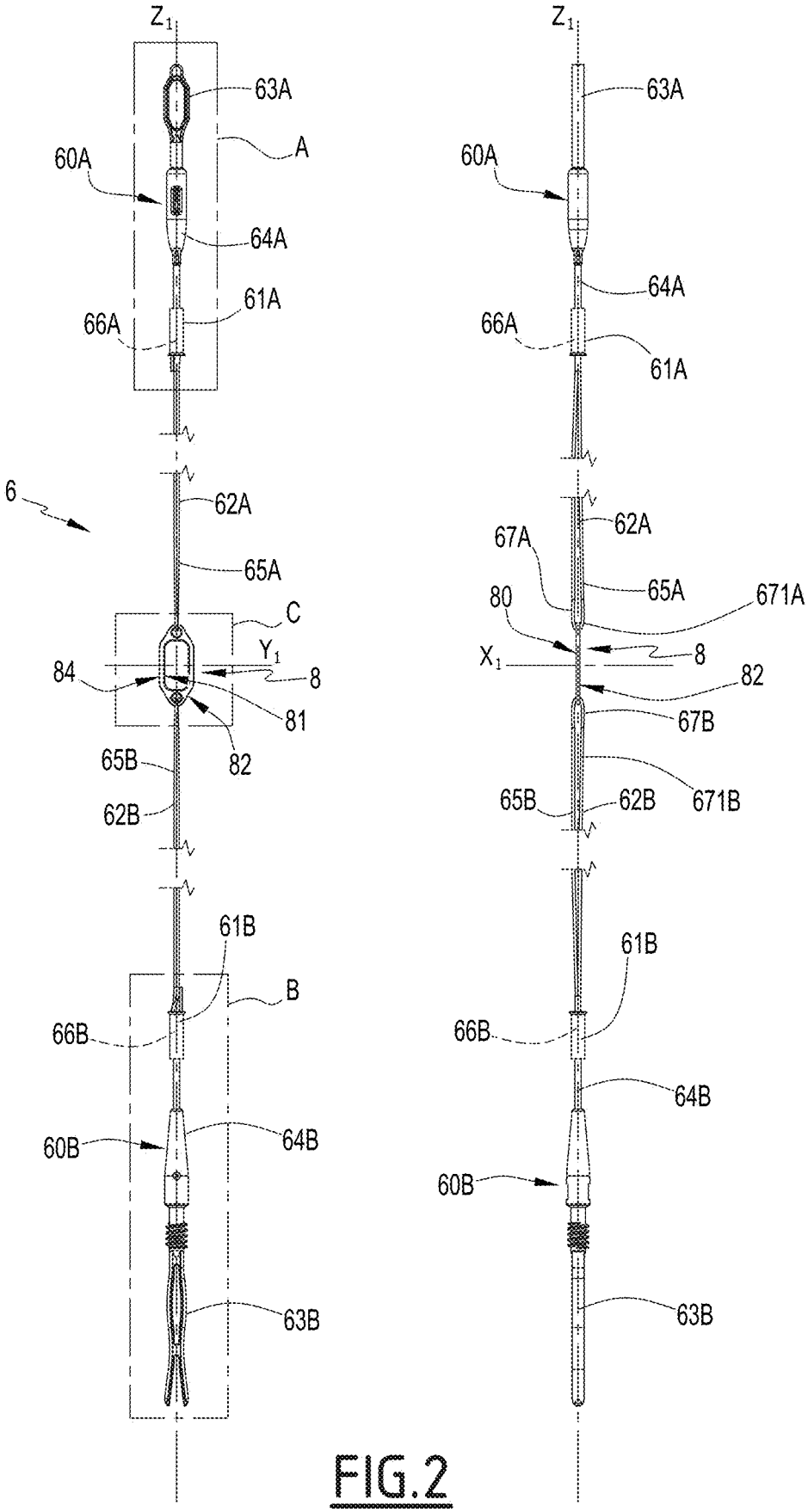
FIG. 2 is a front view and a side view of one of the heddles shown in FIG. 1.

The Jacquard heddle 6 can be seen in more detail in FIG. 2. The Jacquard heddle 6 is configured to be mounted on a Jacquard loom. The Jacquard heddle 6 comprises an upper body 62A, a lower body 62B, a link 8, an upper end connector 60A and a lower end connector 60B.

The upper body 62A of the Jacquard heddle 6 is the only connection between the link 8 and the upper end connector 60A. The upper end connector 60A is distinct from the upper body 62A. The upper body 62A is exclusively formed of a single first thread 65A, preferentially made of nylon, e.g. polyamide 6 or polyamide 6.6 with or without additive, single-filament, without twisting nor undulation, and advantageously with circular constant section, ideally with a diameter d62A of 0.4 mm (millimeters). The upper body 62A is continuous and two end portions 69A of the upper body 62A are connected to the upper end connector 60A. The upper body 62A forms an upper loop 67A, visible in FIGS. 2,4 and in particular 5, which delimits a free opening 671A which extends longitudinally from the connection of the two end portions 69A of the upper body 62A with the upper end connector 60A precisely from the lower longitudinal end of the connection, to an upper hole 83 belonging to the link 8. In other words, the two portions of the upper body 62A extending on both sides of the hole 83 of the link 8 are connected together only at the connection of the upper body 62A with the upper end connector 60A and are not immobilized on the link 8. In a configuration of the Jacquard heddle 6 not mounted in the harness 3, the upper body 62A can thus slide in the upper hole 83 of the link 8 within the limit given by the free opening 671A. The upper body 62A is not twisted around itself or kinked. Ultimately, there is no other connection between the link 8 and the upper end connector 60A than the first wire 65A.

The lower body 62B of the Jacquard heddle 6 is the only connection between the link 8 and the lower end connector 60B. The lower end connector 60B is distinct from the lower body 62B. The lower body 62B is exclusively formed of a second thread 65B, preferentially made of nylon, e.g. polyamide 6 or polyamide 6.6 with or without additive, single-filament, without twisting or undulation, and advantageously of circular constant section, ideally with a diameter d62B of 0.4 mm. The second wire 65B forming the lower body 62B is distinct from the first wire 65A forming the upper body 62A. The lower body 62B is continuous and two end portions 69B of the lower body 62B are connected to the lower end connector 60B. The lower body 62B forms a lower loop 67B, visible in FIGS. 2, 4 and in particular 5, which delimits a free opening 671B which extends longitudinally from the connection of the two end portions 69B of the lower body 62B with the lower end connector 60B, precisely from the upper longitudinal end of the connection, to a lower hole 85 belonging to the link 8. In other words, the two portions of the lower body 62B extending on both sides of the hole 85 of the link 8 are connected together only at the connection of the lower body 62B with the lower end connector 60B and are not immobilized on the link 8. In a configuration of the Jacquard heddle 6 not mounted in the harness 3, the lower body 62B can thus slide freely in the lower hole 85 of the link 8 within the limit given by the free opening 671B. The lower body 62B is not twisted around itself or kinked. Ultimately, there is no other connection between the link 8 and the lower end connector 60B than the second wire 65B.

Figure 3:
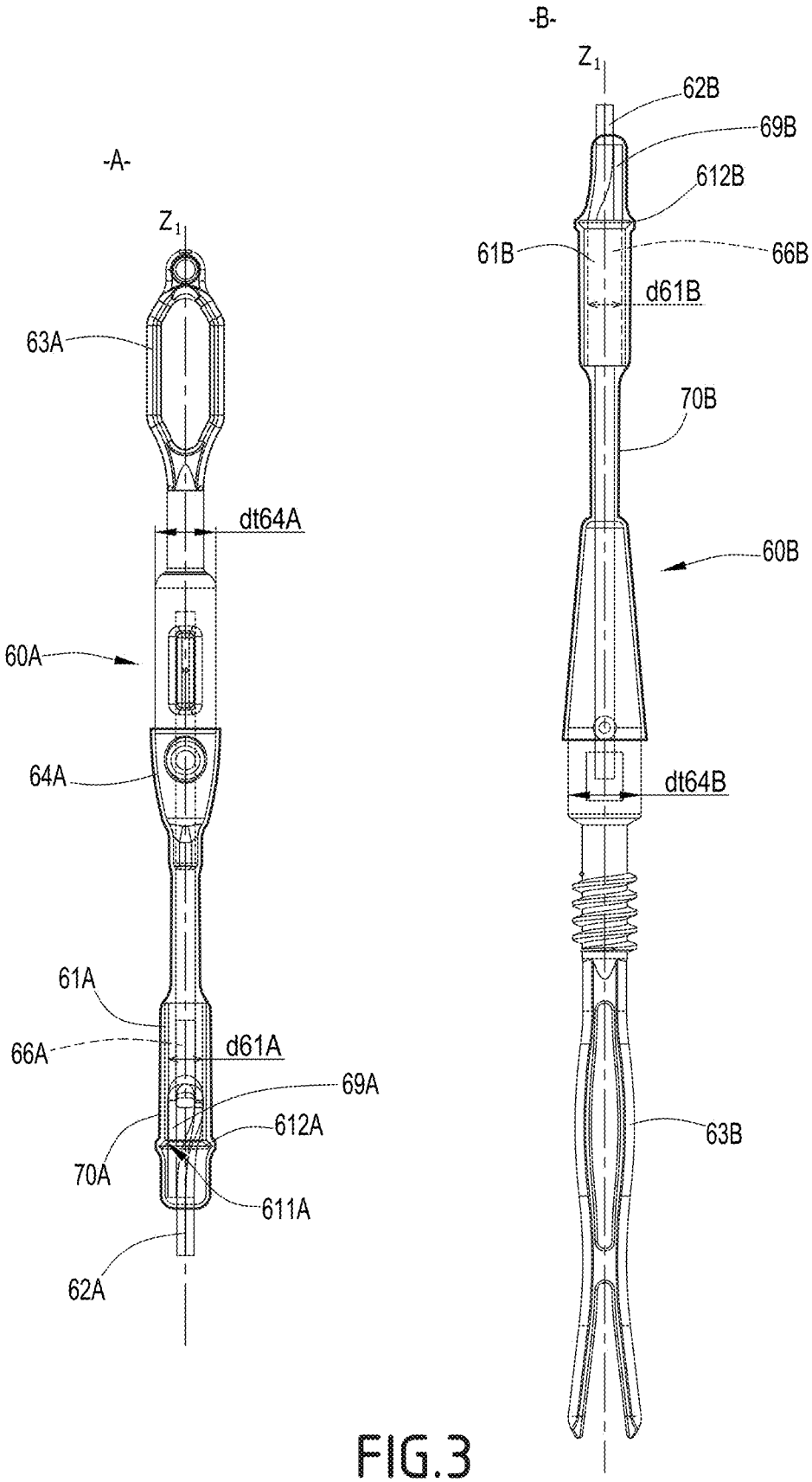
FIG. 3 is a view of a detail and a detail B of FIG. 2.

The Jacquard heddle 6 is connected to the return spring 34 by the lower end connector 60B. The lower end connector 60B, visible in FIGS. 2, 3, 6 and 7, and in particular in FIG. 3, detail B, comprises a body 64B, preferentially made of polymer, elongated along the longitudinal axis Z1, a hook 66B, preferentially made of metal, visible in FIG. 6, a tube 61B and an outer sheath 70B, preferably a heat-shrunk sheath. The body 64B, preferably a screw pitch belonging to the body 64B, forms a fastener 63B, by means of which the body 64B is attached to a first element of the harness 3, more particularly to the return spring 34. The body 64B has a maximum transverse dimension dt64B, measured along an axis perpendicular to the longitudinal axis Z1.

Figure 6:
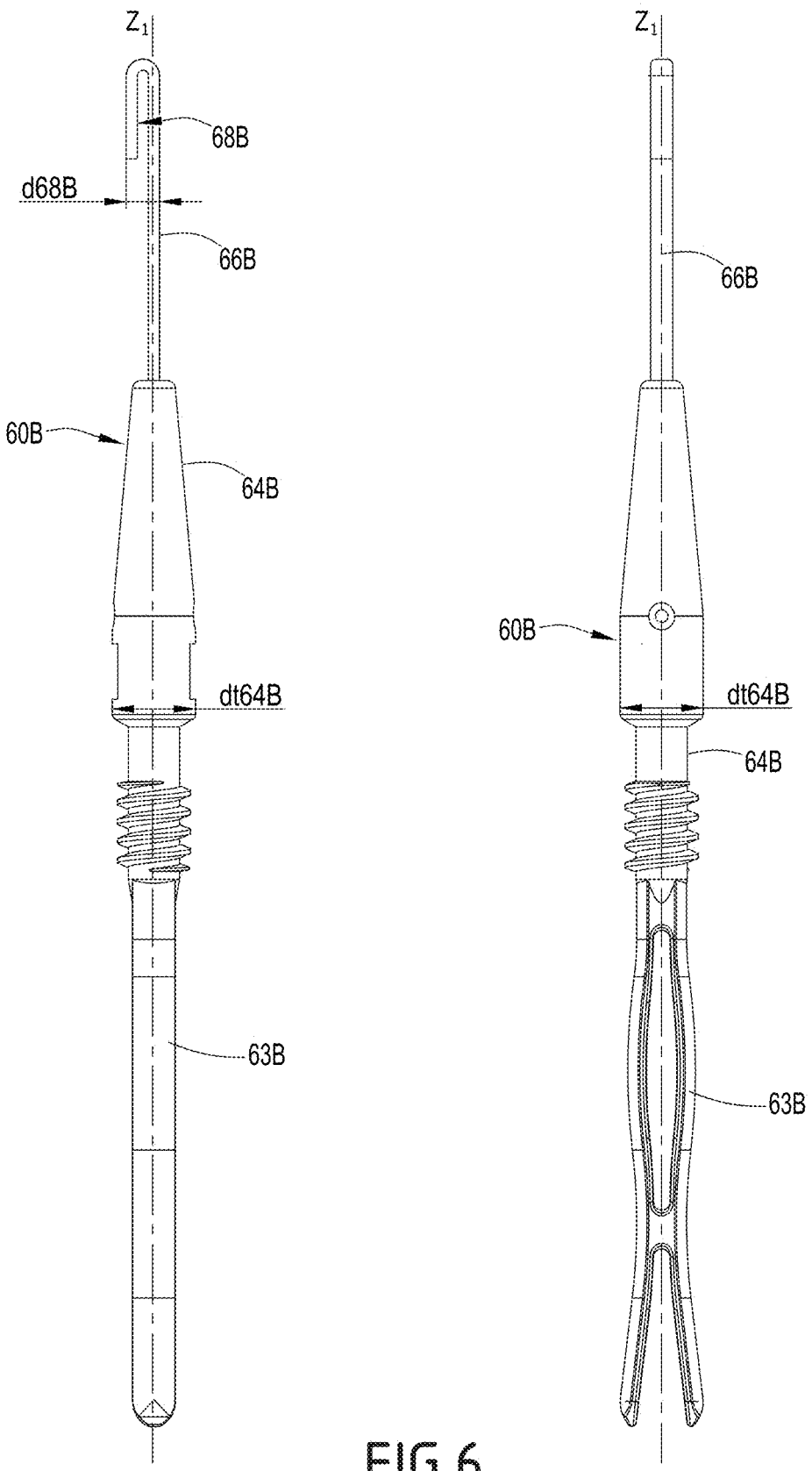
FIG. 6 is a front view and a side view of a lower end connector of the heddle shown in the preceding figures, showing a hook of the lower end connector, before the lower end connector is connected to the lower body.

As can be seen in FIG. 6, the hook 66B delimits a housing 68B passing through along a direction perpendicular to the longitudinal axis Z1. The housing 68B is open along the longitudinal axis Z1 towards the body 64B but closed in the opposite direction. The hook 66B has a maximum lateral dimension d68B measured perpendicularly to the longitudinal axis Z1.

Figure 7:
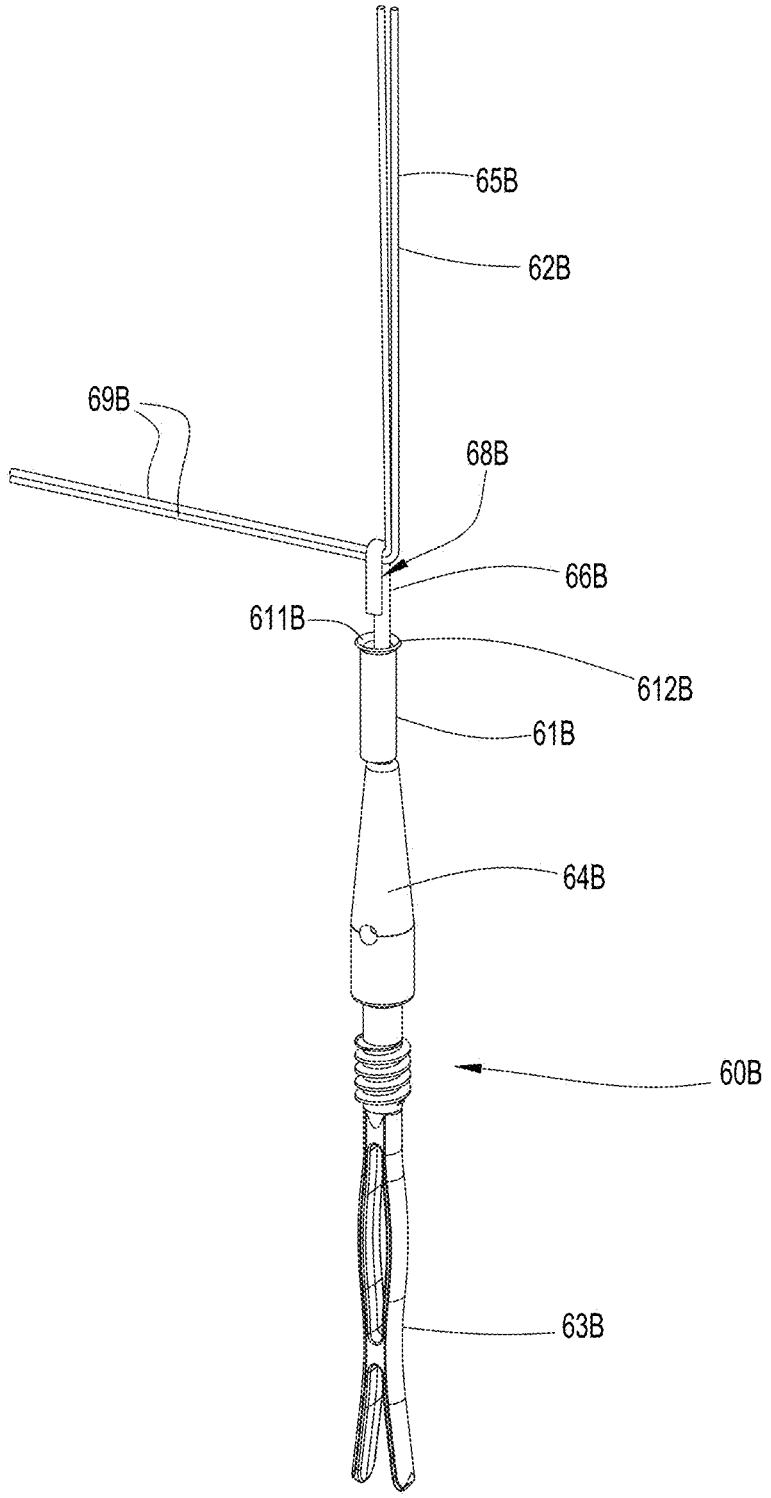
FIG. 7 is a perspective view of a step of the manufacturing of the heddle shown in the preceding figures.

The tube 61B is preferentially made of metal and preferentially has a general shape of revolution about the longitudinal axis Z1. As shown in FIG. 7, the tube 61B advantageously forms an inner funnel 611B and an outer collar 612B. The tube 61B has an inner dimension d61B, measured along the same axis as the maximum lateral dimension d68B of the housing 68B. The inner dimension d61B is greater than the maximum lateral dimension d68B of the housing 68B but less than the maximum transverse dimension dt64B of the body 64B. The inner dimension d61B is preferably less than the sum of the maximum lateral dimension d68B of the housing 68B and twice the diameter d62B of the lower body 62B. The tube 61B is closed insofar as same extends without discontinuity all around the longitudinal axis Z1.

The Jacquard heddle 6 is connected to the arch 32 by the upper end connector 60A. The upper end connector 60A, visible in FIG. 2 and in FIG. 3, detail A, comprises a body 64A, preferentially made of polymer, elongated along the longitudinal axis Z1, a hook 66A, preferentially made of metal, a tube 61A and an outer sheath 70A, preferably a heat-shrunk sheath. The body 64A forms a fastener 63A by means of which the body 64A is attached to a second element of the harness 3, more particularly to the arch 32. The arch 32 is received in an opening delimited by the fastener 63A. The body 64A has a maximum transverse dimension dt64A measured along an axis perpendicular to the longitudinal axis Z1.

The hook 66A delimits a through housing 68A along a direction perpendicular to the longitudinal axis Z1. The housing 68A is open along the longitudinal axis Z1 in the direction of the body 64A but closed in the opposite direction. The hook 66A has a maximum lateral dimension (not shown), measured perpendicularly to the longitudinal axis Z1. The maximum lateral dimension for the hook 66A is measured in the same way as the maximum lateral dimension d66B for the hook 66B.

The tube 61A is advantageously made of metal, of revolution forming an inner funnel 611A, visible in FIG. 3A, and an outer collar flange 612A. An inner dimension d61A of the tube 61A is greater than the maximum lateral dimension of the housing 68A but less than the maximum transverse dimension dt64A of the body 64A. The inner dimension d61A is preferentially less than the sum of the maximum lateral dimension of the housing 68A and twice a diameter d62A of the upper body 62A. The tube 61A is closed insofar as same extends without discontinuity all around the longitudinal axis Z1.

Figure 4:
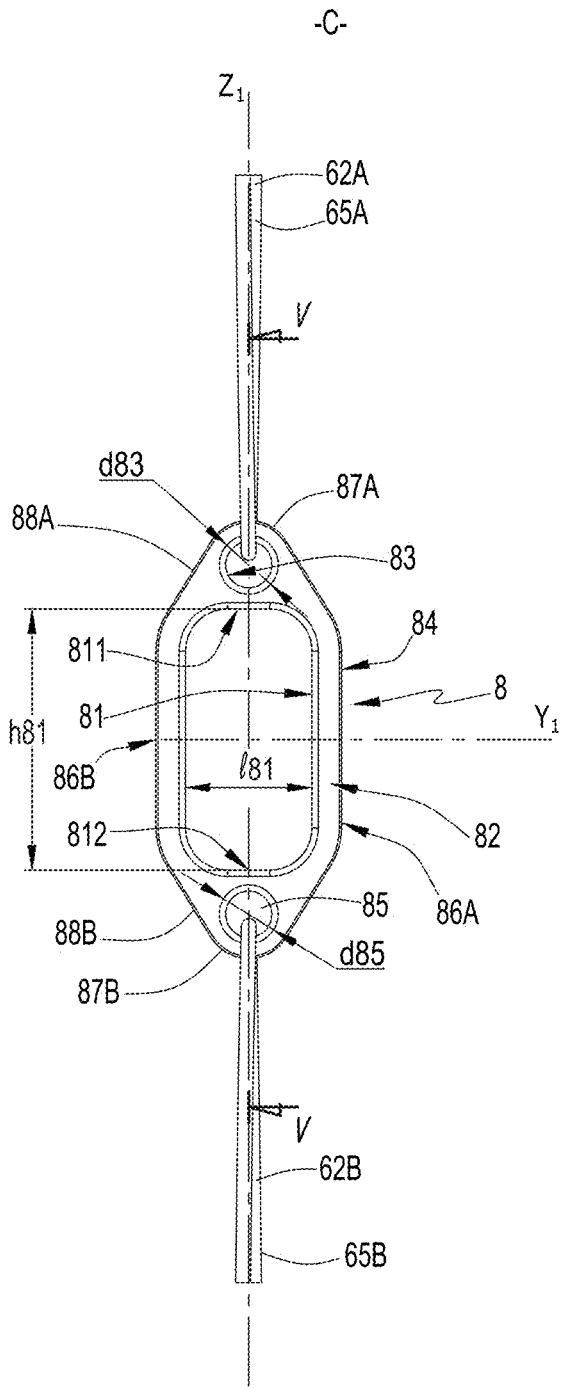
FIG. 4 is a view of a detail C of FIG. 2.
Figure 5:
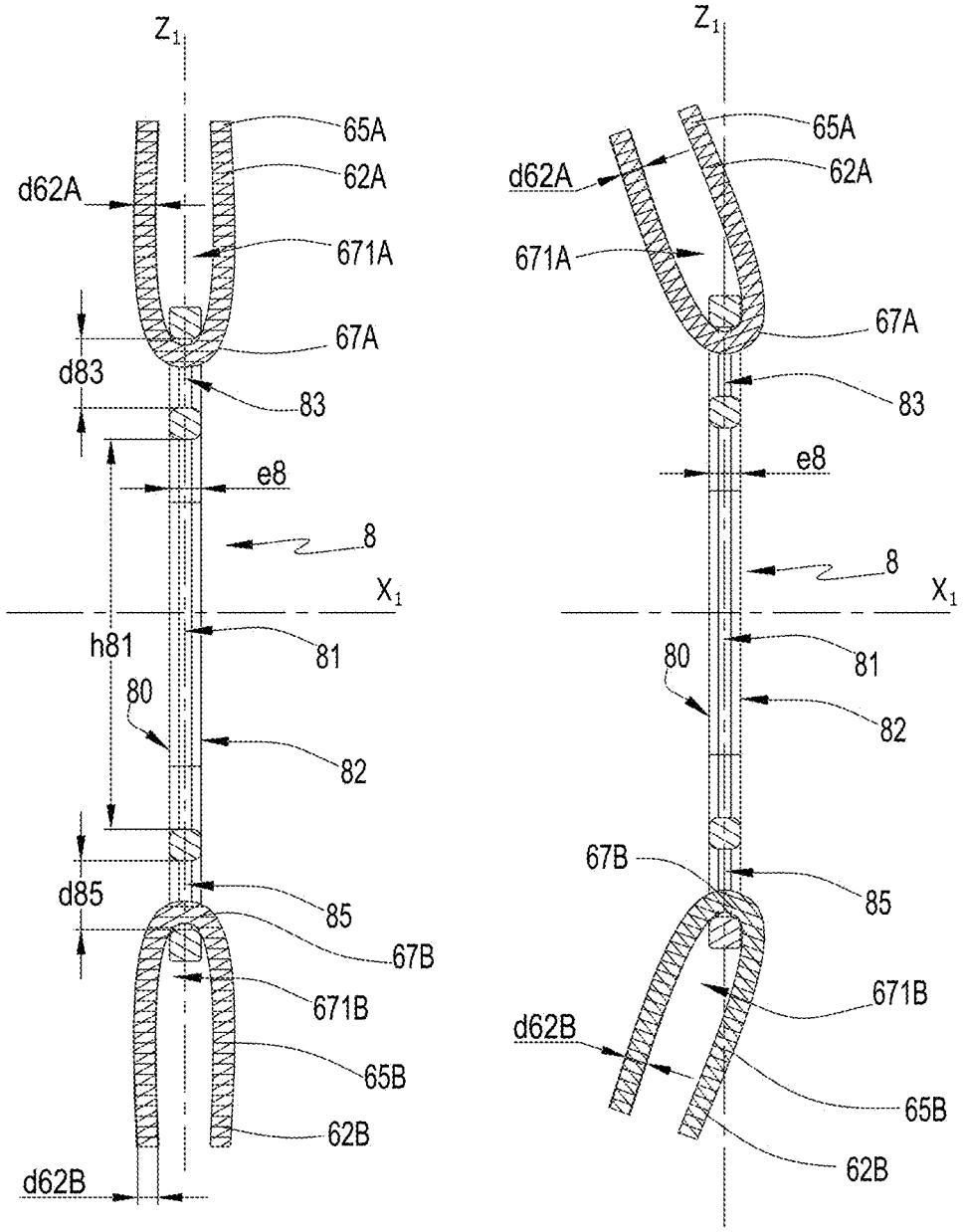
FIG. 5 is a partial longitudinal section of the heddle of the preceding figures along the sectional line V-V shown in FIG. 4, the heddle being shown in a non-bent configuration and in a bent configuration.

The link 8, visible in FIGS. 1 and 2, and in particular in FIGS. 4 and 5, is flat. The link 8 comprises a main face 80 and a main face 82 parallel to and opposite the main face 80. The main faces 80 and 82 are plane and each extend in a plane parallel to the longitudinal plane comprising the longitudinal axis Z1 and a transverse axis Y1 perpendicular to the longitudinal axis Z1. The longitudinal plane is transverse to the feeding direction X1. The link 8 is single-thickness, with a thickness e8, measured between the two main faces 80, 82 perpendicular to the longitudinal axis Z1 and to the transverse axis Y1. The thickness e8 is less than twice the smallest diameter between the diameter d62A of the upper body 62A and the diameter d62B of the lower body 62B, preferentially less than 1.5 times the smallest diameter between the diameter d62A of the upper body 62A and the diameter d62B of the lower body 62B, advantageously 0.5 mm. The link 8 is preferentially made of stainless steel. As a result, it is possible to limit the bulk of the upper 67A and lower 67B loops perpendicular to the main faces and thus to limit the impact of the Jacquard heddle on the density of warp threads.

The link 8 comprises an outer edge 84 which delimits the link 8 throughout the periphery thereof. The outer edge 84 surrounds the main faces 80 and 82 over throughout the entire contour thereof and connects the main faces 80 and 82 together. The outer edge 84 is closed and convex and has a hexagonal shape. Preferably, the outer edge 84 comprises two opposite central portions 86A and 86B, parallel and extending along the longitudinal axis Z1. The outer edge 84 also comprises an upper portion 88A and a lower portion 88B. Each central portion 86A and 86B connects the upper portion 88A to the lower portion 88B.

The upper portion 88A terminates in an upper rounded portion 87A. The upper portion 88A corresponds to a progressive reduction in the width of the main faces 80, 82, the width being measured along the transverse axis Y1 and the reduction taking place from the central portions 86A and 86B toward the upper rounded portion 87A along the longitudinal axis Z1. The lower portion 88B ends with a lower rounded portion 87B. The lower portion 88B corresponds to a progressive reduction of the width of the main faces 80, 82, the width being measured along the transverse axis Y1 and the reduction taking place from the central portions 86A and 86B toward the lower rounded portion 87B along the longitudinal axis Z1.

The link 8 delimits an eye 81, inside the outer edge 84, passing through the link 8 from the main face 80 to the main face 82, i.e. perpendicularly to the longitudinal plane. The eye 81 advantageously has a rectangular shape. The eye 81 has an upper edge 811 and a lower edge 812, the upper edge 811 and/or the lower edge 812 advantageously being flat and perpendicular to the longitudinal axis Z1.

A height h81 of the eye 81, measured parallel to the longitudinal axis Z1, is advantageously equal to 6 mm. The height h81 is at least five times greater than the largest diameter between a diameter d83 of the upper hole 83 and a diameter d85 of the lower hole 85 and strictly greater than twice a width 181 of the eye 81, measured perpendicularly to the longitudinal axis Z1. Over the entire height h81 of the eye 81, the width 181 of the eye 81 is strictly greater than the largest diameter between the diameter d83 of the upper hole 83 and the diameter d85 of the lower hole 85, advantageously the width 181 of the eye is 2.5 to 3.5 times the largest diameter between the diameter d83 of the upper hole 83 and the diameter d85 of the lower hole 85. Advantageously, the diameter d83 and the diameter d85 are equal to 1.1 mm. The bulk of the link 8 in a plane parallel to the longitudinal plane thus stays slightly affected by the arrangement of the upper 83 and lower 85 holes.

Inside the outer edge 84, the link 8 also delimits the upper hole 83, wherein the upper loop 67A of the upper body 62A passes, and the lower hole 85, wherein the lower loop 67B of the lower body 62B passes. The holes 83 and 85 are arranged on both sides of the eye 81 in the direction of the longitudinal axis Z1. The holes 83 and 85 are formed outside the eye 81.

The upper hole 83 and the lower hole 85 pass through the link 8 perpendicularly to the longitudinal plane, connecting the two main faces 80 and 82 of the link.

The upper hole 83 passes through the upper portion 88A of the link. The diameter d83 of the upper hole 83 is greater than the thickness e8 of the link 8, advantageously the diameter d83 of the upper hole 83 is 2 to 2.5 times the thickness e8 of the link 8. The diameter d83 of the upper hole 83 is greater than or equal to twice, preferentially 2.5 times, the diameter d62A of the upper body 62A and is preferentially less than 3.5 times, the diameter d62A of the upper body 62A. Such dimensional relations ensure that the upper body 62A can pivot in the upper hole 83 when the link 8 is pushed by the warp threads 4 along the feeding direction X1 and/or in the longitudinal plane during weaving. Thereby, the bending stress of the Jacquard heddle 6 does not lead to a risk of breaking at the connection between the link 8 and the upper body 62A.

The upper rounded portion 87A is centered on the upper hole 83 and extends over at least 100°, preferably over 120°, symmetrical with respect to the longitudinal axis Z1 and with a tolerance of plus or minus 20°. The difference in radii between the upper rounded portion 87A and the upper hole 83 is equal to the thickness e8 of the link 8, preferentially 1 to 1.25 times the thickness e8 of the link 8.

The lower hole 85 passes through the lower portion 88B of the link. The diameter d85 of the lower hole 85 is greater than the thickness e8 of the link 8, advantageously the diameter d85 of the lower hole 85 is 2 to 2.5 times the thickness e8 of the link 8. The diameter d85 of the lower hole 85 is greater than or equal to twice, preferentially 2.5 times, the diameter d62B of the lower body 62B and is preferentially less than 3.5 times the diameter d62B of the lower body 62B. Such dimensional relations ensure that the lower body 62B can pivot in the lower hole 85 when the link 8 is pushed by the warp threads 4 along the feeding direction X1 and/or perpendicularly to the feeding direction X1 during weaving. Thereby, the bending stress of the Jacquard heddle 6 does not lead to a risk of breaking at the connection between the link 8 and the upper body 62A.

The lower rounded portion 87B is centered on the lower hole 85 and extends over at least 100°, preferably over 120°, symmetrical with respect to the longitudinal axis Z1 and with a tolerance of plus or minus 20°. The difference in radii between the lower rounded portion 87B and the lower hole 85 is equal to the thickness e8 of the link 8, preferentially 1 to 1.25 times the thickness e8 of the link 8.

During weaving, since the eye 81 is rectangular, the warp thread 4, in particular when same is multi-filament and flat, cooperates optimally with the eye 81 through which same passes, in particular with the lower edge 812 and the upper edge 811. More particularly, the warp thread 4 cooperates with the minimum deformation of the section of the warp thread 4.

As the free opening 671B of the lower loop 67B of the lower body 62B around the link 8 is maximum and/or as the main faces 80 and 82 of the link 8 are plane around the lower hole 85, it is possible for the link 8 and the lower body 62B to take different inclinations, some of which are visible in FIG. 5, to adapt to the forces exerted by the adjacent warp threads 4 on the Jacquard heddle 6 and to the warp thread 4 guided by the Jacquard heddle 6. Such adaptation thus occurs with a minimum of stresses between the lower body 62B and the link 8.

Indeed, because of the circular section of the lower body 62B and the circular section of the lower hole 85, without a concavity being formed by the lower hole 85, and because of the respective dimensions thereof, the orientation of the lower body 62B in the lower hole 85 is favored and jamming is prevented.

Moreover, because of the single-filament structure of the lower body 62B and thus of the constant section thereof throughout the length thereof, the orientation of the link 8, in particular of the main faces 80 and 82, with respect to the second wire 65B occurs without jamming.

In addition, the lower loop 67B is not constrained by the thickness e8 of the link 8 during deformation outside the longitudinal plane due to the relatively small thickness e8 of the link 8 and to the minimum difference in radii between the lower rounded portion 87B and the lower hole 85.

Finally, because of the single-filament structure of the second wire 65B forming the lower body 62B and forming the only connection between the link 8 and the lower end connector 60B, the contact of the lower body 62B does not create any catch on an adjacent multi-filament warp thread 4. Moreover, since the lower rounded portion 87B extends widely around the lower hole 85, in the event of orientation of the lower body 62B with respect to the link 8 in the longitudinal plane, the sliding of the warp threads 4 adjacent to the Jacquard heddle 6 of the link 8 toward the lower body 62B and of the lower body 62B toward the link 8, is favored.

Since the free opening 671A of the upper loop 67A of the upper body 62A around the link 8 is maximum and/or since the main faces 80 and 82 of the link 8 are flat around the upper hole 83, it is possible for the link 8 and the upper body 62A to take different inclinations, in order to adapt to the forces exerted by the adjacent warp threads 4 on the Jacquard heddle 6 and to the warp thread 4 guided by the Jacquard heddle 6. Such adaptation occurs with a minimum of stresses between the upper body 62A and the link 8.

Indeed, because of the circular section of the upper body 62A and the circular section of the upper hole 83, without a concavity being formed by the upper hole 83, and because of the respective dimensions thereof, the orientation of the upper body 62A in the upper hole 83 is favored and jamming is prevented.

Moreover, because of the single-filament structure of the upper body 62A and thus of constant section thereof throughout the length thereof, the orientation of the link 8, in particular of the main faces 80 and 82, with respect to the first wire 65A occurs without jamming.

In addition, the upper loop 67A is not constrained by the thickness e8 of the link 8 during deformation outside the longitudinal plane due to the relatively small thickness e8 of the link 8 and to the minimum difference in radii between the upper rounded portion 87A and the upper hole 83.

Finally, because of the single-filament structure of the wire forming the upper body 62A and forming the only connection between the link 8 and the upper end connector 60A, the contact of the upper body 62A does not create any catch on an adjacent multi-filament warp thread 4. Moreover, since the upper rounded portion 87A extends widely around the upper hole 83, in the event of orientation of the upper body 62A with respect to the link in the longitudinal plane, the sliding of the warp threads 4 adjacent to the Jacquard heddle 6 of the link 8 toward the upper body 62A and of the upper body 62A toward the link 8, is favored.

The sheath 70B and the tube 61B are part of the connection between the lower body 62B and the lower end connector 60B. The sheath 70B, forming the outer part of said connection, contributes to making the connection as smooth as possible, without any catch for the neighboring warp threads 4, and protects the tube 61B and the hook 66B from corrosion due to the outer environment, e.g. in the case of weaving using water. The sheath 70B, by extending around the second wire 65B beyond the tube 61B toward the link 8, limits the free opening 671B along the longitudinal axis Z1 toward the lower end connector 60B.

The sheath 70A and the tube 61A are part of the connection between the upper body 62A and the upper end connector 60A. The sheath 70A, forming the outer part of said connection, contributes to making the connection as smooth as possible, without any catch for the neighboring warp threads 4, and protects the tube 61A and the hook 66A from corrosion due to the outer environment, e.g. in the case of weaving using water. The sheath 70A, by extending around the first wire 65A beyond the tube 61A toward the link 8, limits the free opening 671A along the longitudinal axis Z1 toward the upper end connector 60A.

In a variant, depending on the textile application and the warp threads 4 to be woven, the metal link may be made of ceramic or plastic material rather than of metal. In addition, the first wire 65A of the upper body 62A can be made of a material other than Nylon, preferentially another thermoplastic polymer such as polyetheretherketone (Peek), or of metal, advantageously of stainless steel. The second wire 65B of the lower body 62B can be made of a material other than nylon, preferentially another thermoplastic polymer such as polyetheretherketone (Peek), or of metal, advantageously of stainless steel.

In a variant, the lower body 62B is exclusively formed by a second metal single-filament wire 65B and/or the upper body 62A is exclusively formed by a first metal single-filament wire 65A. The end portions 69B of the lower body 62B are connected to the hook 66B by welding and/or the end portions 69A of the upper body 62A are connected to the hook 66A by welding.

An upper body 62A or lower body 62B made of Nylon or stainless steel is compatible with carbon warp threads.

The link 8 is advantageously derived from the cutting of a metal sheet. The upper hole 83, the lower hole 85, the eye 81 and the outer edge 84 are cut and then deburred so as to limit the catches of the warp threads 4.

After the hook 66B has been overmolded and folded, the tube 61B is placed between the fastener 63B and the housing 68B with the possibility of longitudinal movement along the longitudinal axis Z1 with respect to the hook 66B.

When the tube 61B is in longitudinal abutment against the body 64B, the tube 61B is offset longitudinally, along the longitudinal axis Z1, with respect to the housing 68B.

During the manufacture of the Jacquard heddle 6, the lower body 62B is passed through the lower hole 85 of the link 8 to form the lower loop 67B, visible in FIG. 5, around the link 8. The end portions 69B of the lower body 62B are connected to a lower end connector 60B.

As can be seen in FIG. 7, the end portions 69B of the lower body 62B are engaged, preferentially in the same direction, along the through direction of the housing 68B, through the housing 68B of the hook 66B of the lower end connector 60B so as to ensure the correct length of the lower body 62B. The free ends of the lower body 62B are then folded back toward the link 8 from the housing 68B. The tube 61B is then moved with a longitudinal movement along the longitudinal axis Z1 toward the link 8 around the housing 68B and partially around the two end portions 69B. The funnel favors the movement of insertion around the housing 68B. The outer collar flange 612B enhances the support of the tube 61B for the longitudinal movement thereof. The inner surface of the tube 61B presses the end portions 69B of the lower body 62B against the hook 66B. The tube 61B is then plastically deformed around the housing 68B, preferentially with crushing in the direction perpendicular to the through direction of the housing 68B before the crushing of the tube 61B, tightening the hook 66B around the end portions 69B of the lower body 62B to accentuate the jamming of the end portions 69B of the lower body 62B in the housing 68B. The free ends of the lower body 62B, not shown, protruding from the tube 61B are cut and a heat-shrinkable sheath, intended to form the sheath 70B, is fitted around the tube 61B, of the hook 66B, and partially around the body 64B and the second wire 65B, then heated so as to surround, without any play, the tube 61B and the lower end connector 60B, by heat shrinkage. The connection of the lower body 62B to the lower end connector 60B thus comprises locking the end portions 69B with respect to the lower end connector 60B by means of the tube 61B. After such connection, the body 64B extends beyond the end portions 69B along the longitudinal axis Z1 in a direction opposite the link 8. Preferentially, the housing 68B extends through along the transverse axis Y1 and the lateral maximum dimension d68B is arranged perpendicularly to the transverse axis Y1.

After overmolding and folding the hook 66A, the tube 61A is placed fitted between the fastener 63A and the housing 68A with the possibility of longitudinal movement along the longitudinal axis Z1 with respect to the hook 66A.

When the tube 61A is in longitudinal abutment against the body 64A, the tube 61A is offset longitudinally, along the longitudinal axis Z1, with respect to the housing 68A.

During the manufacture of the Jacquard heddle 6, the upper body 62A is passed through the upper hole 83 of the link 8 to form the upper loop 67A, visible in FIG. 5, around the link 8. The end portions 69A of the upper body 62A are connected to an upper end connector 60A.

The end portions 69A of the upper body 62A are engaged, preferentially in the same direction, along the through direction of the housing 68A, through the housing 68A of the hook 66A of the upper end connector 60A so as to ensure the correct length of the upper body 62A. The free ends of the upper body 62A are then folded back toward the link 8 from the housing 68A. The tube 61A is then moved with a longitudinal movement along the longitudinal axis Z1 toward the link 8 around the housing 68A and partially around the two end portions 69A. The funnel favors the movement of insertion around the housing 68A. The outer collar flange 612A enhances the support of the tube 61A for the longitudinal movement thereof. The inner surface of the tube 61A presses the end portions 69A of the upper body 62A against the hook 66A. The tube 61A is then plastically deformed around the housing 68A, preferentially with a crushing in the direction perpendicular to the through direction of the housing 68A before the crushing of the tube 61A, tightening the hook 66A around the end portions 69A of the upper body 62A to accentuate the jamming of the end portions 69A of the upper body 62A in the housing 68A. The free ends of the upper body 62A, not shown, protruding from the tube 61A are cut and a heat-shrinkable sheath, intended to form the sheath 70A, is fitted around the tube 61A, of the hook 66A, and partially around the body 64A and the first wire 65A, then heated so as to surround, without any play, the tube 61A and the upper end connector 60A, by heat shrinkage. The connection of the upper body 62A to the upper end connector 60A thus comprises locking the end portions 69A with respect to the upper end connector 60A by means of the tube 61A. After the connection, the body 64A extends beyond the end portions 69A along the longitudinal axis Z1 in a direction opposite the link 8. Preferentially, the housing 68A is through along the transverse axis Y1 and the maximum lateral dimension is arranged perpendicularly to the transverse axis Y1.

In a variant, the diameter d83 of the upper hole 83, and the diameter d85 of the inner hole 85 respectively, is less than or equal to 6 times, preferentially 5.5 times, the diameter d62A of the upper body 62A, and the diameter d62B of the lower body 62B respectively. The diameters d62A and d62B are e.g. equal to 0.2 mm and the diameters d85 and d83 are equal to 1.1 mm.

Figure 8:
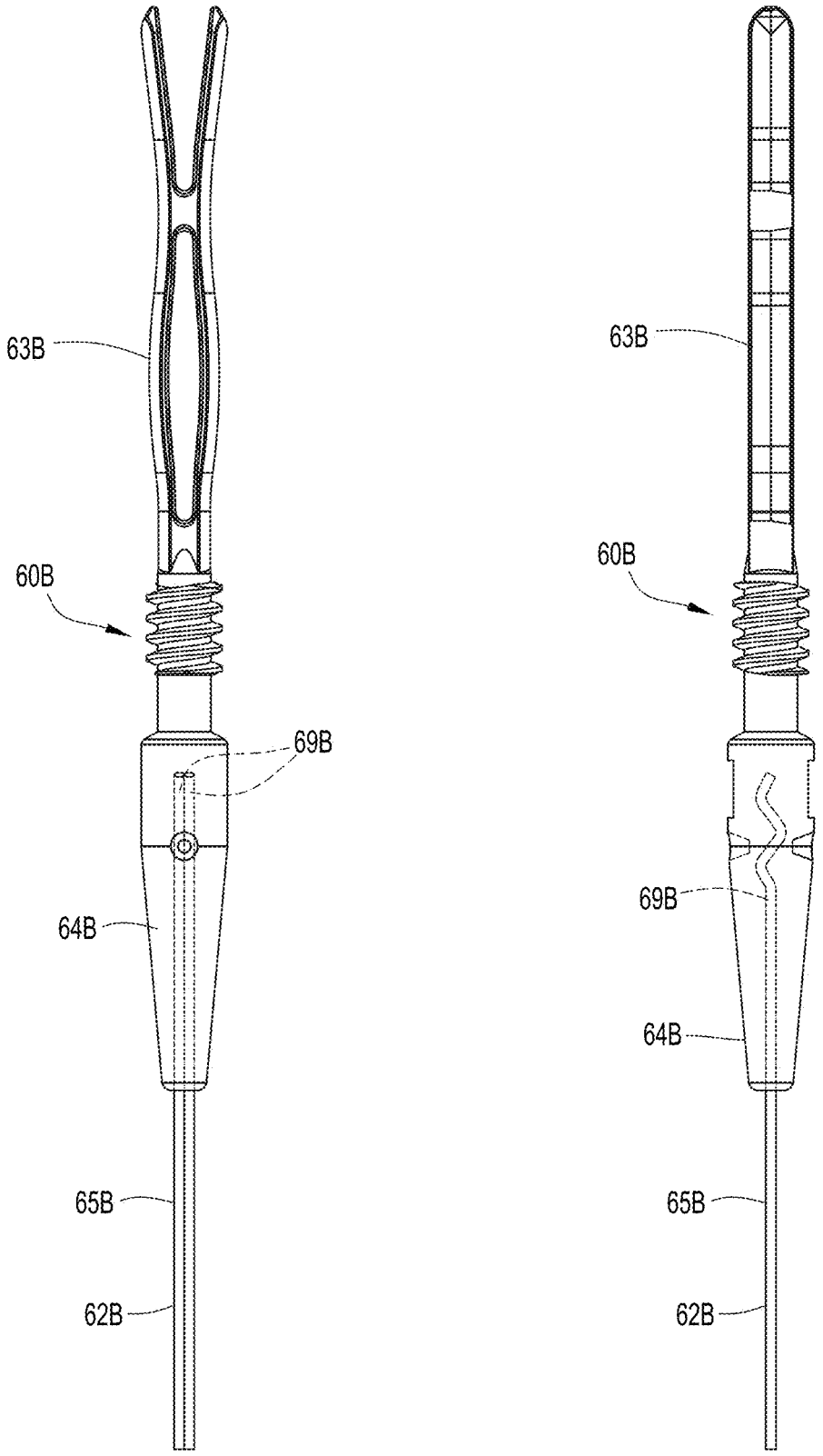
FIG. 8 is a side view and a front view of a lower end connector belonging to a Jacquard heddle according to a second embodiment of the invention.

FIG. 8 illustrates a second embodiment of the Jacquard heddle 6, identical to the first embodiment except for the features described hereinafter. The second wire 65B of the lower body 62B is a round single-filament wire of constant section throughout the length thereof, without twisting or undulation, made of stainless steel, of diameter d62B less than 0.5 times the diameter d85 of the lower hole 85 wherein the lower body 62B is engaged. After fitting the lower body 62B into the lower hole 85 of the link 8 so as to form the Jacquard heddle 6 of the correct length, the end portions 69B of the lower body 62B are shaped, advantageously in the shape of a wavelet, and are overmolded in the body 64B of the lower end connector 60B. The first wire 65A of the upper body 62A is a round single-filament wire of constant cross-section throughout the length thereof, without twisting or undulation, made of stainless steel, of diameter d62A less than 0.5 times the diameter d83 of the upper hole 83 wherein the upper body 62A is engaged. After fitting the upper body 62A into the upper hole 83 of the link 8 so as to form the Jacquard heddle 6 of the correct length, the end portions 69A of the upper body 62A are shaped, advantageously in the shape of a wavelet, and are overmolded in the body 64A of the upper end connector 60A. Each end portion 69B, 69A can also be shaped before the fitting of the lower body 62B into the lower hole 85 and the fitting of the upper body 62A into the upper hole 83. After overmolding, a sheath of the type of the heat-shrunk sheath 70A, 70B, respectively, can be fitted around the body 64A, and the body 64B respectively, and partially around the first wire 65A, and partially around the second wire 65B respectively.

In a variant (not shown), the two end portions of one of the upper body 62A and the lower body 62B are shaped and overmolded in the body of the associated end connector while the two end portions of the other of the upper body 62A and the lower body 62B are connected to the associated end connector by means of a tube, as in the first embodiment.

Figure 9:
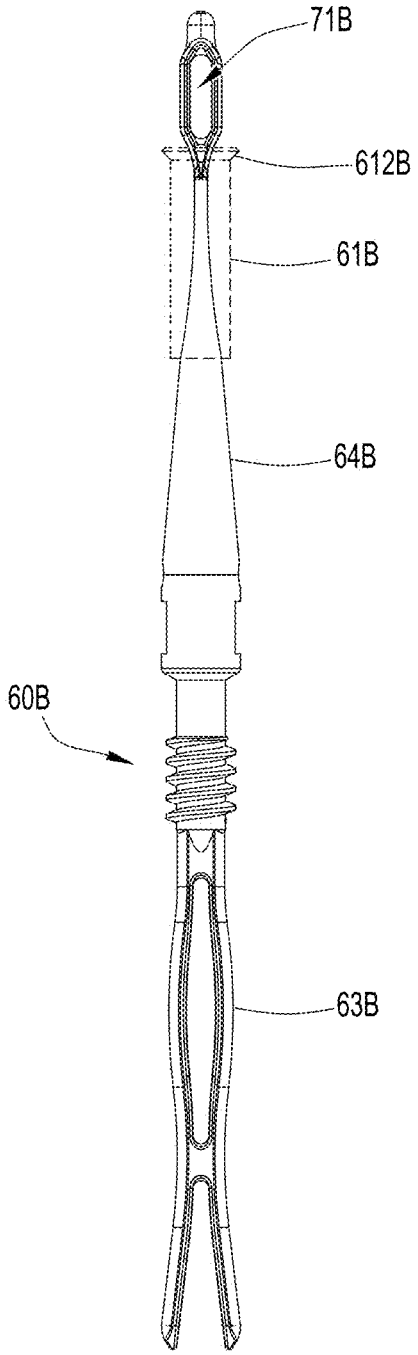
FIG. 9 is a front view of a lower end connector belonging to a Jacquard heddle according to a third embodiment of the invention.

FIG. 9 illustrates a third embodiment of the Jacquard heddle 6, identical to the first embodiment except for the features described hereinafter. A closed housing 71B is formed directly in the polymer body 64B of the lower end connector 60B and/or a closed housing (not shown), is formed directly in the polymer body 64A of the upper end connector 60A. The closed housing of the body 64A and the closed housing 71B of the body 64B, respectively, receive the upper body 62A, the lower body 62B for the connection thereof with the upper end connector 60A and the lower end connector 60B. A tube 61B, shown in dotted lines in FIG. 9, is apt to be moved longitudinally around the closed housing 71B of the body 64B for the connection between the lower body 62B and the lower end connector 60B. A tube 61A, similar to the tube 61A of the first embodiment, is apt to be moved longitudinally around the closed housing of the body 64A for the connection between the upper body 62A and the upper end connector 60A.

In all embodiments, the first single-filament wire or the second single-filament wire consists of a single solid round filament the diameter of which corresponds to the diameter of the wire throughout the length thereof. A Nylon single-filament wire is obtained directly by extruding the polymer through a hole the diameter of which corresponds to the diameter of the wire. A metal single-filament wire is obtained directly from wire drawing so as to obtain a diameter corresponding to the diameter of the wire. A single-filament wire within the meaning of the invention excludes any wire obtained by braiding or twisting a plurality of filaments and is not intended to be braided or twisted with another wire. More particularly, a metal single-filament wire excludes any braided cable.

Any feature described hereinabove for one embodiment or one variant is applicable to the other embodiments and variants described hereinabove, as far as is technically possible.

The invention claimed is:

1. A Jacquard heddle for guiding a warp thread for a Jacquard loom, the Jacquard heddle extending along a longitudinal axis and comprising:

a link, comprising a convex outer edge and two flat, parallel and opposite main faces, the link being traversed, from one of the main faces to the other, by an eye for a passage of the warp thread, by an upper hole and by a lower hole, the upper hole and the lower hole being arranged on both sides of the eye along the longitudinal axis;

a first wire, engaging the upper hole and forming an upper loop; and a second wire, which is distinct from the first wire and which is engaged in the lower hole forming a lower loop;

the Jacquard heddle comprises an upper end connector, comprising means of connection to a first element of a Jacquard harness, two end portions of the first wire being connected to the upper end connector;

the Jacquard heddle comprises a lower end connector, comprising means of connection to a second element of the Jacquard harness, two end portions of the second wire being connected to the lower end connector;

the upper hole has a circular cross-section; and the lower hole has a circular cross-section, wherein:

the upper loop delimits a free opening extending, along the longitudinal axis, from the upper hole to the connection of the two end portions of the first wire with the upper end connector;

the lower loop delimits a free opening extending, along the longitudinal axis, from the lower hole to the connection of the two end portions of the second wire with the lower end connector;

the first wire is the only connection between the link and the upper end connector and is a single filament wire of constant diameter; and the second wire is the only connection between the link and the lower end connector and is a single-filament wire of constant diameter.

2. The Jacquard heddle according to claim 1, wherein:

a diameter of the upper hole is greater than or equal to twice, the diameter of the first wire, diameter of the upper hole being greater than or equal to 2.5 times the diameter of the first wire; and a diameter of the lower hole is greater than or equal to twice, the diameter of the second wire, diameter of the lower hole being greater than or equal to 2.5 times the diameter of the second wire.

3. The Jacquard heddle according to claim 2, wherein:

the diameter of the upper hole is greater than or equal to 2.5 times the diameter of the first wire; and the diameter of the lower hole is greater than or equal to 2.5 times the diameter of the second wire.

4. The Jacquard heddle according to claim 1, wherein a thickness of the link, measured from one of the main faces to the other, perpendicular to the longitudinal axis, is less than twice the smallest diameter between the diameter of the first wire and the diameter of the second wire.

5. The Jacquard heddle according to claim 1, wherein the outer edge of the link comprises two central portions which extend along the longitudinal axis and an upper portion and a lower portion respectively, ending with an upper rounded portion and a lower rounded portion respectively, and wherein the upper portion, and the lower portion respectively corresponds to a progressive reduction in width of the main faces from the central portions toward the upper rounded portion and the lower rounded portion, respectively, the width being taken along a direction perpendicular to the longitudinal axis and parallel to the main faces.

6. The Jacquard heddle according to claim 5, wherein:

the upper rounding is centered on the upper hole and extends at least 100° around the center of the upper hole; and the lower rounded portion is centered on the lower hole and extends over at least 100° around the center of the lower hole.

7. The Jacquard heddle according to claim 1, wherein a height of the eye, measured parallel to the longitudinal axis, is at least five times greater than a largest diameter between a diameter of the upper hole and a diameter of the lower hole.

8. The Jacquard heddle according to claim 1, wherein the link is made of metal, preferably of stainless steel.

9. The Jacquard heddle according to claim 1, wherein the eye comprises an upper edge and a lower edge, delimiting the eye along the longitudinal axis, the upper edge and the lower edge being perpendicular to the longitudinal axis and wherein a width of the eye is strictly greater than the largest diameter between the diameter of the upper hole and the diameter of the lower hole.

10. The Jacquard heddle according to claim 9, wherein the width of the eye is 2.5 to 3.5 times greater than the largest diameter between the diameter of the upper hole and the diameter of the lower hole.

11. The Jacquard heddle according to claim 1, wherein the first wire and the second wire are made of Nylon.

12. The Jacquard heddle according to claim 1, wherein the first wire and the second wire are made of metal.

13. The Jacquard heddle according to claim 12, wherein:

the upper end connector is made of a polymer material, overmolded on the two end portions of the first wire; and the lower end connector is made of polymer material, overmolded on the two end portions of the second wire.

14. The Jacquard heddle according to f claim 1, wherein:

the upper end connector comprises a housing extending through along a direction perpendicular to the longitudinal axis for the partial reception of the two end portions of the first wire, which are connected thereto; and the lower end connector, comprises a housing extending through along a direction perpendicular to the longitudinal axis for the partial reception of the two end portions of the second wire which are connected thereto.

15. The Jacquard heddle according to claim 14, wherein:

the connection between the two end portions of the first wire and the upper end connector comprises a tube, arranged around the housing and pressing the two end portions of the first wire into contact with the upper end connector; and the connection between the two end portions of the second wire and the lower end connector comprises a tube, arranged around the housing and pressing the two end portions of the second wire into contact with the lower end connector.

16. The Jacquard heddle according to claim 1, wherein:

the connection between the two end portions of the first wire and the upper end connector comprises an outer sheath which is partially arranged around the upper end connector and the first wire; and the connection between the two end portions of the second wire and the lower end connector comprises an outer sheath which is partially arranged around the lower end connector and the second wire.

17. A Jacquard loom comprising a plurality of Jacquard heddles, wherein at least one of the Jacquard heddles is according to claim 1.

* * * * *